US008376014B2

(12) United States Patent
Wu

(10) Patent No.: US 8,376,014 B2
(45) Date of Patent: Feb. 19, 2013

(54) CORRUGATOR HAVING MULTIPLE CORRUGATION ROLLER SETS

(76) Inventor: Kuan-Shiung Wu, Yangmei Township, Taoyuan County (TW)

( * ) Notice: Subject to any disclaimer, the term of this patent is extended or adjusted under 35 U.S.C. 154(b) by 260 days.

(21) Appl. No.: 12/779,056

(22) Filed: May 13, 2010

(65) Prior Publication Data

US 2011/0240228 A1 Oct. 6, 2011

(30) Foreign Application Priority Data

Apr. 6, 2010 (TW) ..... 99205977 U

(51) Int. Cl.
*B31F 1/28* (2006.01)

(52) U.S. Cl. ..... 156/472; 156/471

(58) Field of Classification Search ..... 156/205, 156/210, 470–473
See application file for complete search history.

(56) References Cited

U.S. PATENT DOCUMENTS 4,627,831 A * 12/1986 Hirakawa et al. ..... 493/337
4,631,109 A * 12/1986 Hirakawa et al. ..... 156/472
4,818,330 A * 4/1989 Mosburger ..... 156/473

FOREIGN PATENT DOCUMENTS

EP 233293 A1 * 8/1987

* cited by examiner

*Primary Examiner* — Barbara J. Musser
(74) *Attorney, Agent, or Firm* — Leong C. Lei

(57) ABSTRACT

A corrugator includes a chassis, which is composed of two opposite and spaced primary wall panels; a rotary main shaft, which is rotatably mounted between the two primary wall panels of the chassis and has opposite ends respectively coupled to roller support seats; two corrugation roller sets, which are detachably mounted to the two roller support seats and each including two detachable secondary wall panels; and a hold-down roller, which is mounted to the chassis at a location close to one of the corrugation roller sets. With the multiple sets of corrugation rollers mounted in the corrugator, the corrugator allows a user to select and manufacture corrugator boards of different specifications.

8 Claims, 8 Drawing Sheets

CORRUGATOR HAVING MULTIPLE CORRUGATION ROLLER SETS

(a) TECHNICAL FIELD OF THE INVENTION

The present invention generally relates to a corrugator, and more particularly to a corrugator that comprises two or more sets of corrugation rollers to allow for selection of set-up to match the type of corrugation desired to be manufactured and allow for immediate shut down at the time when it is desired to switch to a different type of corrugation in a manufacturing process for making a rotation of 180 degrees of the internal structure thereof to switch to the another set of corrugation rollers that corresponds to the said different type of corrugation and the manufacturing operation can then be continued.

(b) DESCRIPTION OF THE PRIOR ART

A single-sided corrugated board is formed of a flat sheet of paper and a pleated or corrugated sheet of paper to form a reinforced compound board. The corrugated board can be deposited in a packaging box or case or be used to make a packaging box or case for providing cushioning effect to the articles deposited in the packaging box or case and reducing potential risk of damage on the articles during the transportation thereof.

Taiwan Utility Model No. 85210494 discloses a conventional corrugator for manufacturing a single-sided corrugated board, which comprises a chassis, a corrugation roller set, a surface paper roller set, and an adhesive application roller. The corrugation roller set comprises two rollers each having a surface forming teeth in a corrugated fashion for deforming a core paper sheet into a corrugated or pleated form. The surface paper roller set functions to convey a sheet of surface paper. In operation, the core paper and the surface paper are respectively conveyed through the corrugation roller set and the surface paper roller set and then both pass through the adhesive application roller to bond to each other thereby forming a single-sided corrugated board. The adhesive application roller carries adhesive deposited thereon, whereby when the core paper passes through the adhesive application roller, the adhesive is applied to the core paper to bond the surface paper for forming the single-sided corrugated board.

However, the conventional corrugator only comprises a single set of corrugation rollers and this arrangement prevents it from efficiently switching between different corrugation roller sets for making single-sided corrugated boards of different types. To make different types of corrugated boards with the conventional corrugators, at least two corrugators must be installed. Apparently, the existing corrugator shows poor applicability and is adverse to the reduction of manufacturing costs of the corrugated boards.

SUMMARY OF THE INVENTION

In view of the limited applicability of the existing corrugator machines, the present invention aims to provide a corrugator having multiple corrugation roller sets in order to overcome the insufficiency and drawbacks of the existing machines.

The primary objective of the present invention is to provide a corrugator having multiple corrugation roller sets. The corrugator of the present invention comprises two or more sets of corrugation rollers. The corrugator allows for selection of set-up to match the type of corrugation desired to be manufactured. When it is desired to switch to a different type of corrugation in a manufacturing process, the corrugator can be immediately shut down for a while in which the internal structure of the corrugator is caused to rotate 180 degrees to switch to the another set of corrugation rollers that corresponds to the said different type of corrugation and the manufacturing operation can then be continued.

To achieve the above objective, the present invention provides a corrugator having multiple corrugation roller sets. The corrugator comprises the following constituent components:

A chassis is composed of two opposite and spaced primary wall panels.

A rotary main shaft is rotatably mounted between the two primary wall panels of the chassis. Opposite ends of the rotary main shaft are respectively coupled to roller support seats.

Two corrugation roller sets are detachably mounted to the two roller support seats. Each of the corrugation roller sets comprises two detachable secondary wall panels, a primary corrugation roller, and a secondary corrugation roller. The two detachable secondary wall panels are respectively and detachably mounted to the two roller support seats. The primary corrugation roller is rotatably mounted between the detachable secondary wall panels. The secondary corrugation roller is rotatably mounted between the detachable secondary wall panels.

A hold-down roller is mounted to the chassis at a location close to one of the corrugation roller sets.

With the above discussed technical solution, since the corrugator is equipped with two or more sets of corrugation rollers, during the manufacturing of corrugated boards, an operator may easily select a desired one of the two corrugation roller sets that matches the type of corrugation to be manufactured. When it is desired to switch to a different type of corrugation, the machine can be immediately shut down for a very short period in which the rotary main shaft is caused to rotate 180 degrees to switch to the other set of corrugation rollers that corresponds to the said different type of corrugation and the manufacturing operation can then be continued.

Further, the corrugation roller sets are coupled to the rotary main shaft in a detachable manner. When it is desired to use a new corrugation roller set that carries a third type of corrugation, an empty electrical cart that carries no corrugation roller set thereon is fed in for quickly dismounting and removing one of the corrugation roller sets from the corrugator and another electrical cart that is pre-loaded with the third corrugation roller set is moved in to a location below the corrugator for mounting the third roller set. In this way, a corrugator is allowed to use more than three types of corrugation rollers 30 for diversification of manufacturing.

The primary corrugation roller and the secondary corrugation roller of each of the corrugation roller sets form a plurality of corrugation teeth.

The primary corrugation roller and the secondary corrugation roller of one of the corrugation roller sets may form corrugation teeth that are of a size different from the corrugation teeth formed on the primary corrugation roller and the secondary corrugation roller of the other corrugation roller set.

The two corrugation roller sets can be arranged in a symmetric manner with respect to the roller support seats.

Each primary corrugation roller has an axle and each secondary corrugation roller has an axle.

Each corrugation roller set comprises two clutch devices, which are respectively mounted to the two detachable secondary wall panels to control the secondary corrugation roller moving toward or away from the primary corrugation roller.

For the two clutch devices mentioned above, each clutch device comprises a swing arm and a force-application hydraulic cylinder. The two swing arms are respectively associated with the two detachable secondary wall panels, and each swing arm is pivotally coupled to the respective detachable secondary wall panel. The swing arm has an end rotatably coupled to the axle of the secondary corrugation roller. The two force-application hydraulic cylinders are respectively mounted to the detachable secondary wall panels and are respectively associated with the swing arms. Each force-application hydraulic cylinder comprises an extendible/retractable bar connected to the respective swing arm to control the swing arm for moving the secondary corrugation roller toward or away from the primary corrugation roller. Each of the roller support seats is provided, at opposite ends thereof, with at least one positioning hydraulic cylinder. Each positioning hydraulic cylinder carries and drives an extendible/retractable fixation pin. The detachable secondary wall panels of each corrugation roller set are each provided with at least one positioning seat, which forms a positioning slot to selectively receive the fixation pin of the respective positioning hydraulic cylinder to fit therein or separate therefrom.

One of the primary wall panels is provided with a rotation positioning hydraulic cylinder, which carries and drives an extendible/retractable positioning pin. The detachable secondary wall panels of one of the corrugation roller sets is provided with a rotation positioning seat, which forms a positioning slot for selectively receiving the positioning pin of the rotation positioning hydraulic cylinder to fit therein or separate therefrom. When the positioning pin is fit in the positioning slot, the two corrugation roller sets are angularly positioned at the same altitude to allow one of the corrugation roller sets to perform operation.

The hold-down roller has an axle that has two ends each rotatably coupled to a lever, which is pivoted at a middle portion thereof to one of the primary wall panels corresponding thereto. Further, the lever has an end, which is opposite to the hold-down roller and is rotatably coupled to a force-application hydraulic cylinder. The force-application hydraulic cylinder is mounted to the corresponding primary wall panel and comprises an extendible/retractable driving rod that is coupled to the lever.

The corrugator further comprises an adhesive application roller, which is arranged between the two primary wall panels to carry adhesive deposited thereon. The adhesive application roller is located close to one of the primary corrugation roller and the secondary corrugation roller of one of the corrugation roller sets.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
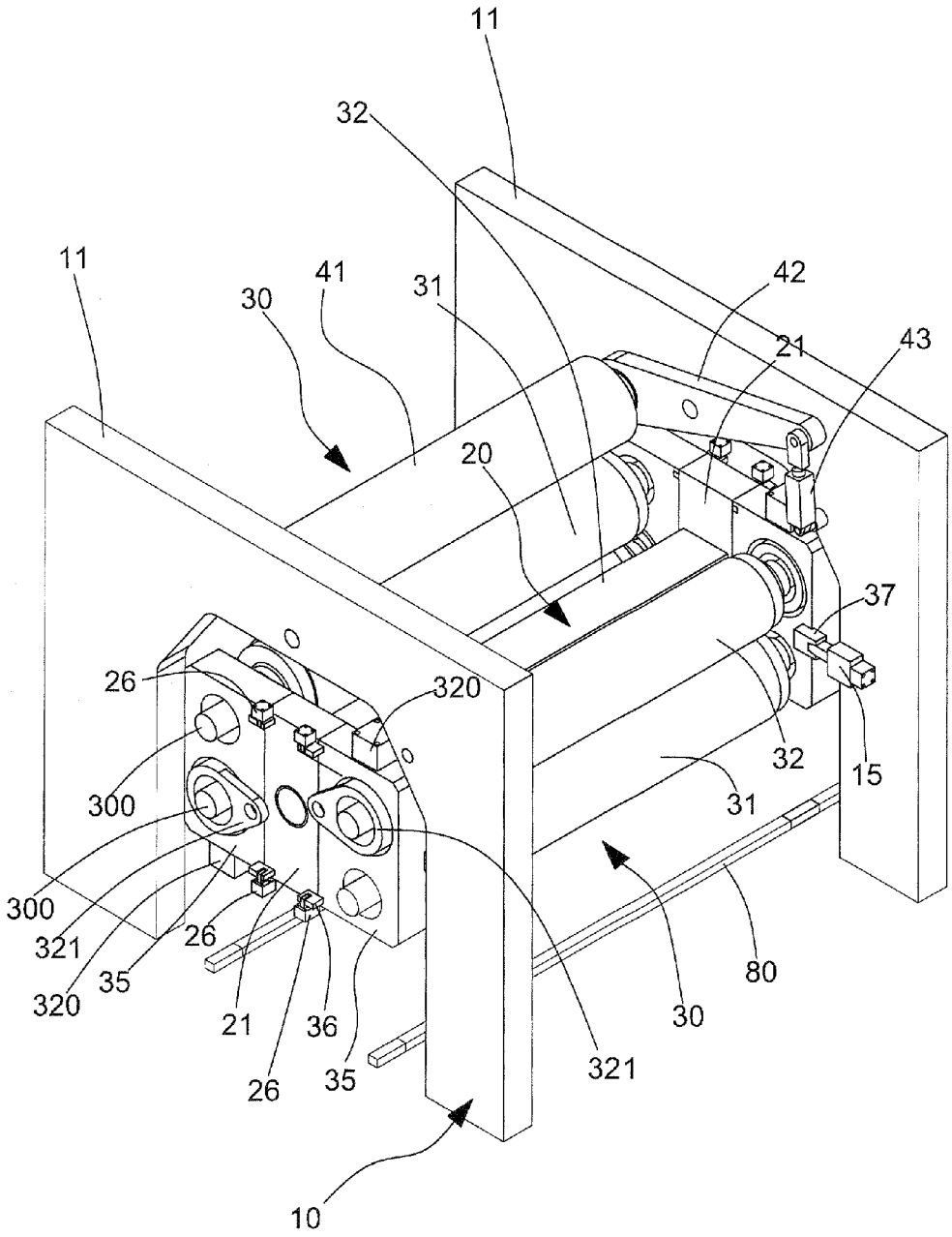
FIG. 1 is a perspective view showing a corrugator according to the present invention.
Figure 2:
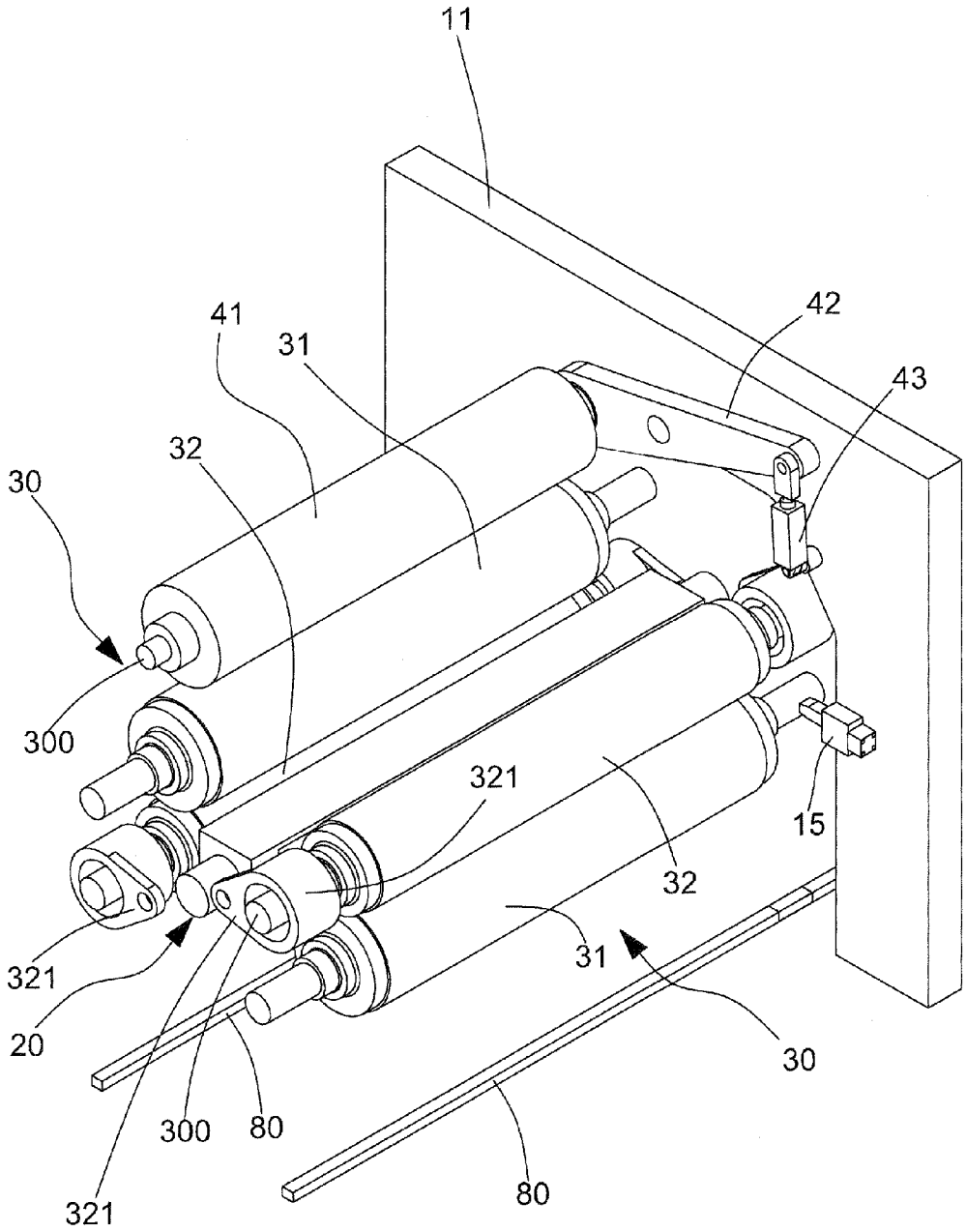
FIG. 2 is a perspective view showing the corrugator of the present invention with one primary wall panel removed.
Figure 3:
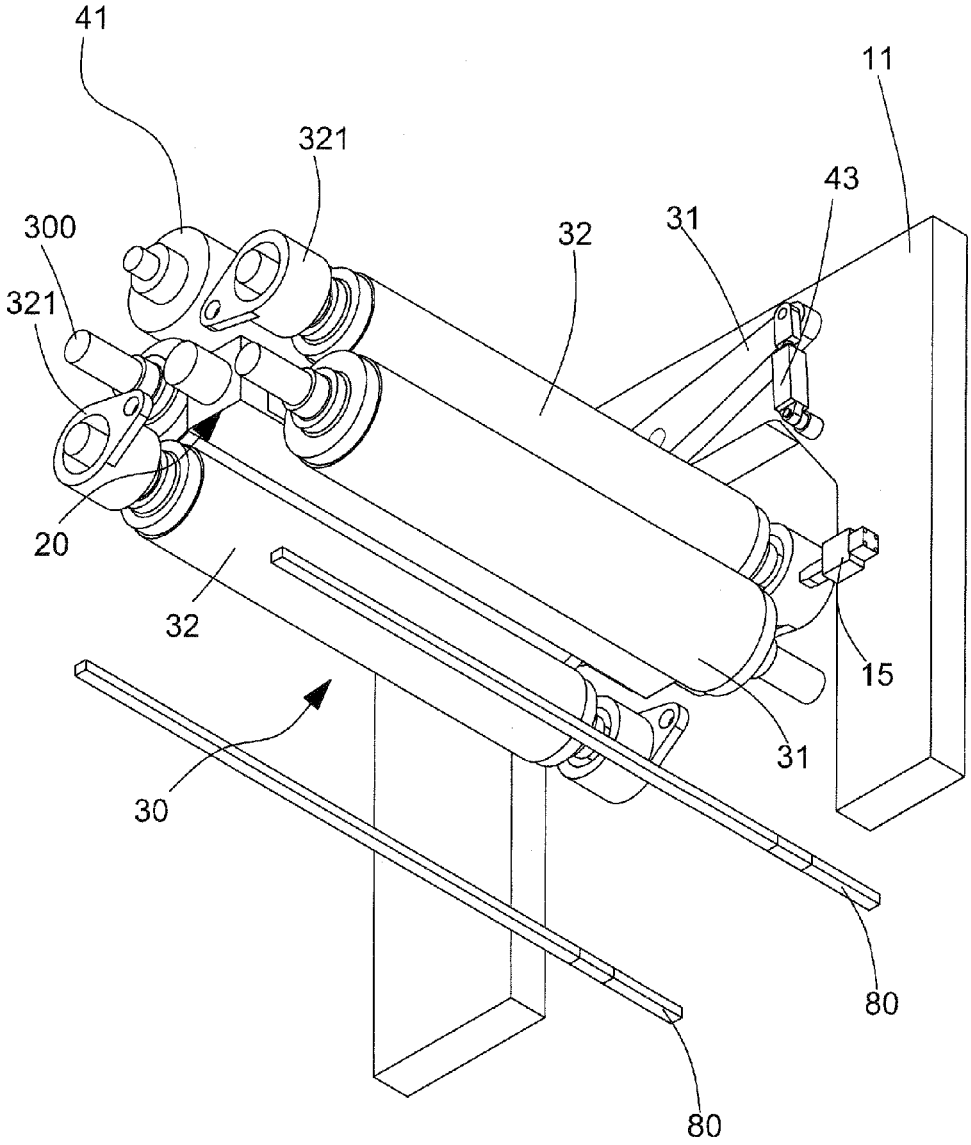
FIG. 3 is another perspective view of the corrugator of the present invention with one primary wall panel removed.
Figure 4:
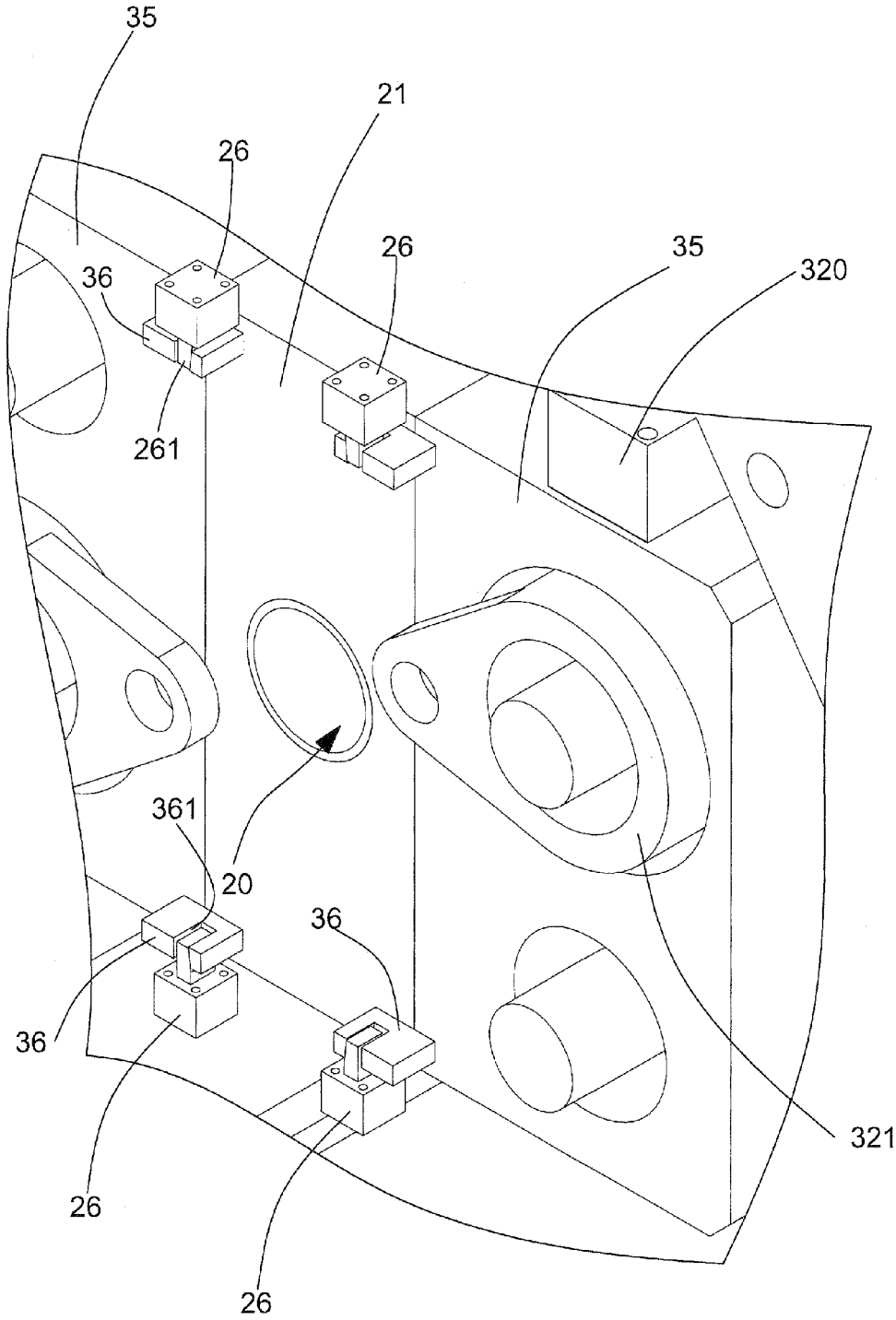
FIG. 4 is an enlarged perspective view of a portion of the corrugator of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1-5, the present invention provides a corrugator that comprises multiple sets of corrugation rollers. The corrugator comprises a chassis 10, a rotary main shaft 20, two corrugation roller sets 30, a hold-down roller 41, and an adhesive application roller 51.

The chassis 10 is composed of two opposite and spaced primary wall panels 11.

The rotary main shaft 20 is rotatably mounted between the two primary wall panels 11 of the chassis 10. Opposite ends of the rotary main shaft 20 are respectively coupled to roller support seats 21.

Referring to FIGS. 1-5, the two corrugation roller sets 30 are detachably mounted to the two roller support seats 21. Each of the corrugation roller sets 30 comprises two detachable secondary wall panels 35, a primary corrugation roller 31, and a secondary corrugation roller 32. As an alternative or expanded embodiment of the present invention, the corrugator may receive three or more than three corrugation roller sets 30 mounted thereto.

The two detachable secondary wall panels 35 of each corrugation roller set 30 are respectively and detachably mounted to the two roller support seats 21.

Each primary corrugation roller 31 is rotatably mounted between the respective detachable secondary wall panels 35. Each of the primary corrugation rollers 31 has an axle 300.

Each secondary corrugation roller 32 is rotatably mounted between the respective detachable secondary wall panels 35. Each of the secondary corrugation rollers has an axle 300.

The primary corrugation roller 31 and the secondary corrugation roller 32 of each of the corrugation roller sets 30 form corrugation teeth, which apply indentations to a core paper 91 to make pleats on the core paper 91.

In a preferred embodiment of the present invention, the primary corrugation roller 31 and the secondary corrugation roller 32 of one of the corrugation roller sets 30 may form corrugation teeth that are of a size different from the corrugation teeth formed on the primary corrugation roller 31 and the secondary corrugation roller 32 of the other corrugation roller set 30 in order to allow for manufacturing core paper sheets 91 of different pleat densities and thus forming a single-side corrugated board having different cushioning and protection effect.

In a preferred embodiment of the present invention, the two corrugation roller sets 30 are arranged in a symmetric manner with respect to the roller support seats 21.

Further, in a preferred embodiment of the present invention, each corrugation roller set 30 comprises two clutch devices, which are respectively mounted to the two detachable secondary wall panels to control the secondary corrugation roller 32 moving toward or away from the respective primary corrugation roller 31.

For the two clutch devices mentioned above, each clutch device comprises a swing arm 321 and a force-application hydraulic cylinder 320. The two swing arms 321 are respectively associated with the two detachable secondary wall panels 35, and each swing arm 321 is pivotally coupled to the respective detachable secondary wall panel 35. The swing arm 321 has an end rotatably coupled to the axle 300 of the secondary corrugation roller 32. The two force-application hydraulic cylinders 320 are respectively mounted to the detachable secondary wall panels 35 and are respectively associated with the swing arms 321. Each force-application hydraulic cylinder 320 comprises an extendible/retractable bar connected to the respective swing arm 321 to control the swing arm 321 for moving the secondary corrugation roller 32 toward or away from the respective primary corrugation roller 31.

Figure 5:
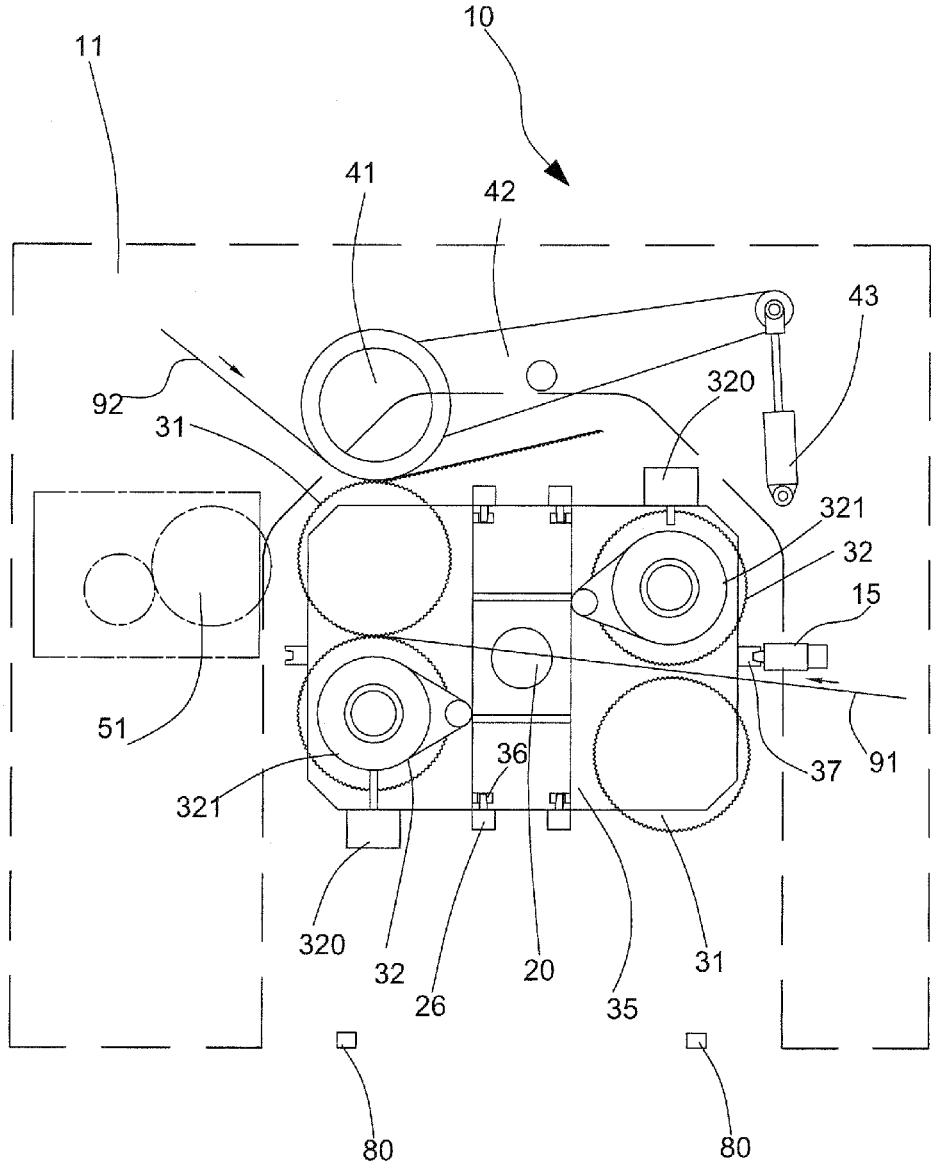
FIG. 5 is a schematic side elevational view of the corrugator of the present invention showing a hold-down roller approaching a primary corrugator roller.

As shown in FIG. 5, the left-hand side corrugation roller set 30 is controlled by the clutch devices to have the primary corrugation roller 31 and the secondary corrugation roller 32 moving toward each other for processing the core paper 91, while the right-hand side corrugation roller set 30 is controlled by the clutch devices to have the primary corrugation roller 31 and the secondary corrugation roller 32 moving away from each other, forming a gap through which the core paper 91 is allowed to pass.

The hold-down roller 41 is mounted to the chassis 10 at a location close to one of the corrugation roller sets 30, whereby a surface paper sheet 92 can be conveyed by the hold-down roller 41 in such a way that the surface paper 92 overlaps the core paper sheet 91 that has been indented and forming pleats as being moved along a common downstream path, whereby the surface paper 92 and the pleated core paper 91 are bonded to each other to form a corrugated board.

The adhesive application roller 51 is arranged between the two primary wall panels 11 with adhesive deposited thereon. The adhesive application roller 51 is located close to one of the primary corrugation roller 31 and the secondary corrugation roller 32 of one of the corrugation roller sets 30.

In a preferred embodiment of the present invention, each of the roller support seats 21 is provided, at opposite ends thereof, with at least one positioning hydraulic cylinder 26. Each positioning hydraulic cylinder 26 carries and drives an extendible/retractable fixation pin 261. The detachable secondary wall panels 35 of each corrugation roller set 30 are each provided with at least one positioning seat 36, which forms a positioning slot 361 to selectively receive the fixation pin 261 of the respective positioning hydraulic cylinder 26 to fit therein or separate therefrom.

Further, in a preferred embodiment of the present invention, one of the primary wall panels 11 is provided with a rotation positioning hydraulic cylinder 15, which carries and drives an extendible/retractable positioning pin. The detachable secondary wall panels 35 of one of the corrugation roller sets 30 is provided with a rotation positioning seat 37, which forms a positioning slot for selectively receiving the positioning pin of the rotation positioning hydraulic cylinder 15 to fit therein or separate therefrom. When the positioning pin is fit in the positioning slot, the two corrugation roller sets 30 are angularly positioned at the same altitude to allow one of the corrugation roller sets 30 to perform operation.

Figure 6:
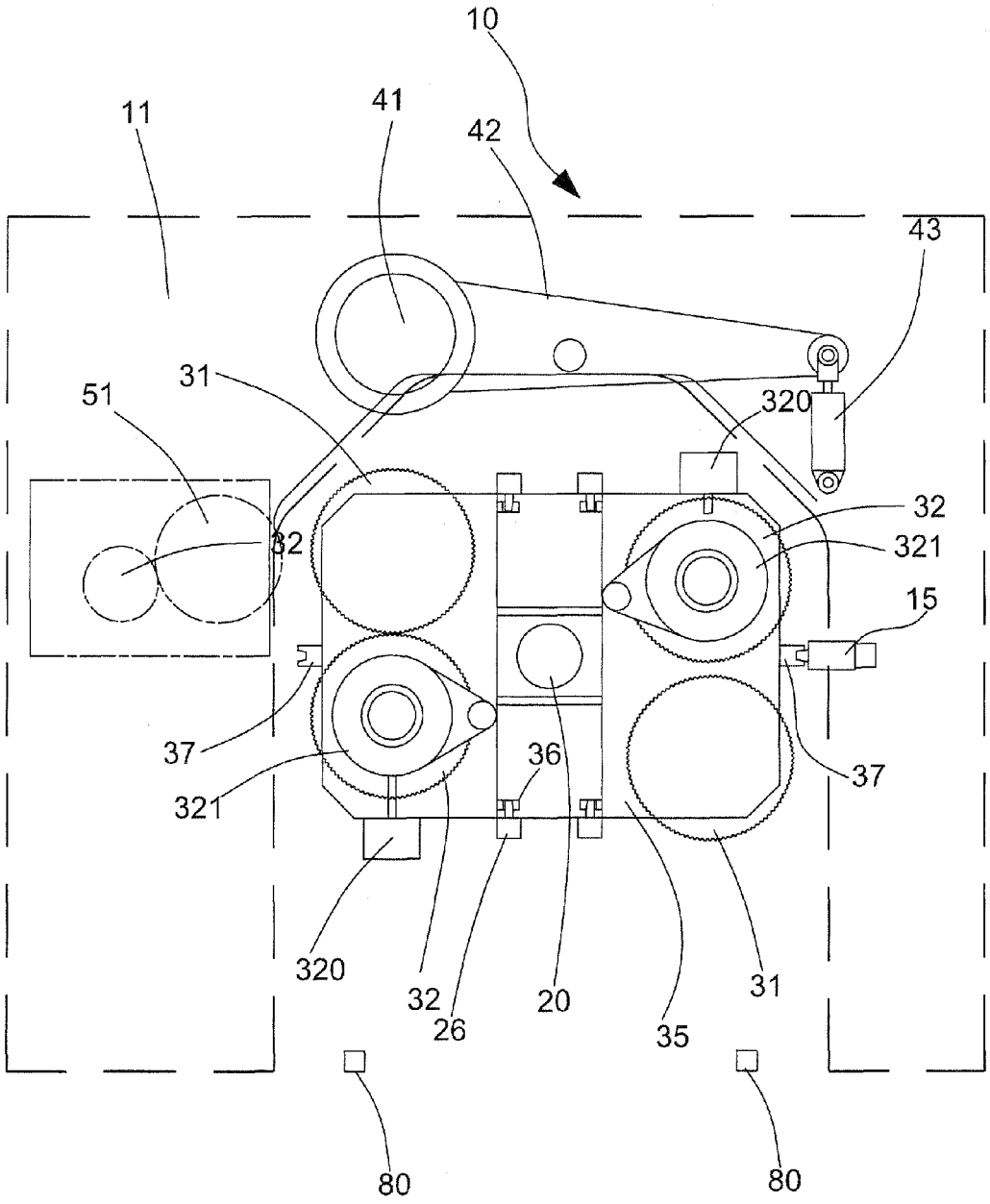
FIG. 6 is a schematic side elevational view similar to FIG. 5 but showing the hold-down roller moved away from the primary corrugator roller.

Further referring to FIG. 6, in a preferred embodiment of the present invention, the hold-down roller 41 has an axle that has two ends each rotatably coupled to a lever 42, which is pivoted at a middle portion thereof to one of the primary wall panels 11 corresponding thereto. Further, the lever 42 has an end, which is opposite to the hold-down roller 41 and is rotatably coupled to a force-application hydraulic cylinder 43. The force-application hydraulic cylinder 43 is mounted to the corresponding primary wall panel 11 and comprises an extendible/retractable driving rod that is coupled to the lever 42.

Figure 7:
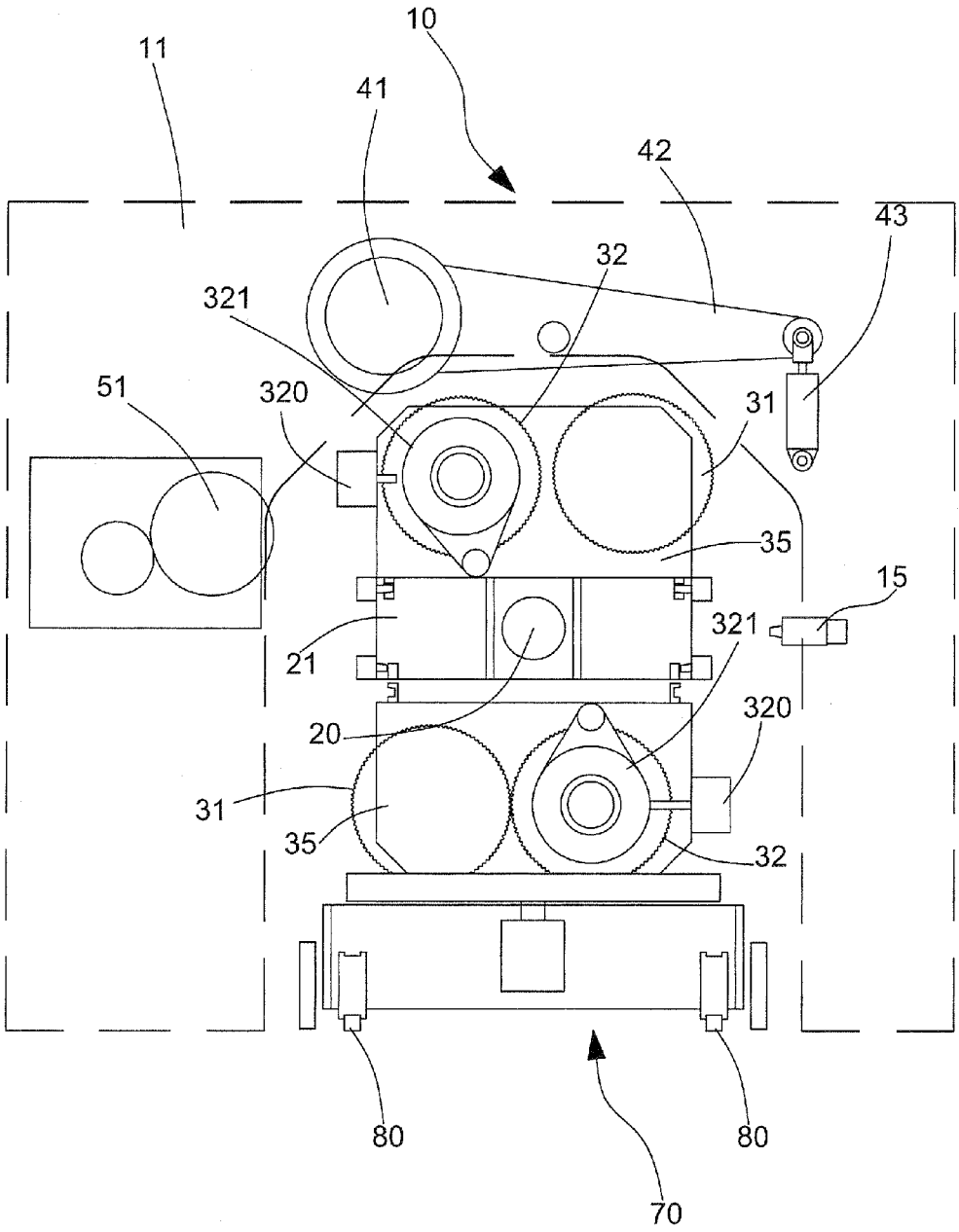
FIG. 7 is a schematic side elevational view showing a main shaft of the corrugator of the present invention is rotated by 90 degrees.
Figure 8:
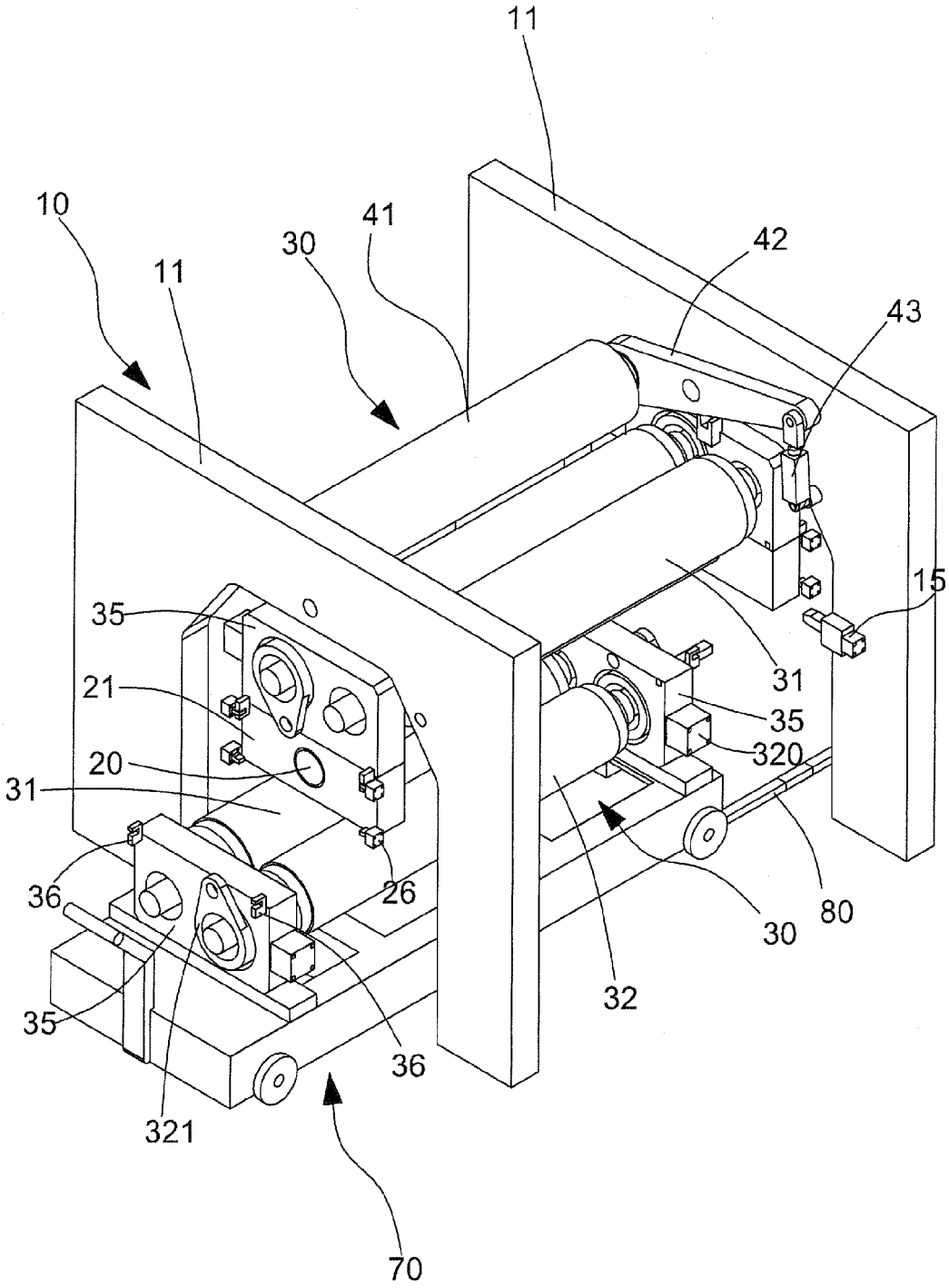
FIG. 8 is a perspective view showing the corrugator of the present invention and an electrical cart.

Further referring to FIGS. 7 and 8, two rails 80 are arranged below the primary wall panels 11 of the corrugator. In an attempt to dismount and replace one of the corrugation roller sets 30, the rotation positioning hydraulic cylinder 15 that is mounted to the primary wall panels 11 is first released to release the rotary main shaft 20 from a secured condition and then the rotary main shaft 20 and the two corrugation roller sets 30 are rotated by 90 degrees to have one of the corrugation roller sets 30 to be dismounted located at the lowest position, meaning at the six o'clock direction of the rotary main shaft 20. An empty electrical cart 70 is prepared and the electrical cart 70 is moved through the empty space below the primary wall panels 11 with wheels of the electrical cart 70 roll along the rails 80 to reach a location below the corrugation roller sets 30. At this time, the positioning hydraulic cylinders 26 of the roller support seats 21 that are located lower are released to allow the fixation pins 261 disengaging from the positioning slots of the positioning seats of the corrugation roller set 30 thereby allowing the corrugation roller set 30 to be separated from the corrugator. The electrical cart 70 is then moved out and another electrical cart 70 that carries a new, third corrugation roller set 30 is moved in to allow the third corrugation roller sets 30 to be mounted to the corrugator in substantially the same process. Thus, the operation of replacing corrugation roller set 30 can be performed in a very efficient manner.

With the above discussed technical solution, since the corrugator is equipped with two or more sets of corrugation rollers 30, during the manufacturing of corrugated boards, an operator may easily select a desired one of the two corrugation roller sets that matches the type of corrugation to be manufactured. When it is desired to switch to a different type of corrugation, the machine is shut down for a very short period in which the rotary main shaft 20 is caused to rotate 180 degrees to switch to the other set of corrugation rollers that corresponds to the said different type of corrugation and the manufacturing operation can then be continued.

Further, the corrugation roller sets 30 are coupled to the rotary main shaft 20 in a detachable manner. When it is desired to use a new corrugation roller set 30 that carries a third type of corrugation, an empty electrical cart 70 that carries no corrugation roller set 30 thereon is fed in for quickly dismounting and removing one of the corrugation roller sets 30 from the corrugator and another electrical cart 70 that is pre-loaded with the third corrugation roller set 30 is moved in to a location below the corrugator for mounting the third roller set. In this way, a corrugator is allowed to use more than three types of corrugation rollers 30 for diversification of manufacturing.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A corrugator comprising:

a chassis, which is composed of two opposite and spaced primary wall panels;

a rotary main shaft, which is rotatably mounted between the two primary wall panels of the chassis, the rotary main shaft having opposite ends that are respectively coupled to roller support seats;

two corrugation roller sets, which are detachably mounted to the two roller support seats, each of the corrugation roller sets comprising two detachable secondary wall panels, a primary corrugation roller, and a secondary corrugation roller, the two detachable secondary wall panels being respectively and detachably mounted to the two roller support seats, the primary corrugation roller being rotatably mounted between the detachable secondary wall panels, the secondary corrugation roller being rotatably mounted between the detachable secondary wall panels, each of the corrugation roller sets comprising two clutch devices, which are respectively mounted to the two detachable secondary wall panels to control the secondary corrugation roller moving toward or away from the primary corrugation roller; and a hold-down roller, which is mounted to the chassis at a location close to one of the corrugation roller sets;

wherein each of the clutch devices comprises a swing arm and a force-application hydraulic cylinder, the two swing arms being respectively associated with the two detachable secondary wall panels, each swing arm being pivotally coupled to the respective detachable secondary wall panel, the swing arm having an end rotatably coupled to the axle of the secondary corrugation roller, the two force-application hydraulic cylinders being respectively mounted to the detachable secondary wall panels and respectively associated with the swing arms, each of the force-application hydraulic cylinders comprising an extendible/retractable bar connected to the respective swing arm to control the swing arm for moving the secondary corrugation roller toward or away from the primary corrugation roller; and each of the roller support seats is provided, at opposite ends thereof, with at least one positioning hydraulic cylinder, which carries and drives an extendible/retractable fixation pin, the detachable secondary wall panels of each of the corrugation roller sets being each provided with at least one positioning seat, which forms a positioning slot to selectively receive the fixation pin of the respective positioning hydraulic cylinder to fit therein or separate therefrom.

2. The corrugator according to claim 1, wherein the primary corrugation roller and the secondary corrugation roller of each of the corrugation roller sets form a plurality of corrugation teeth.

3. The corrugator according to claim 2, wherein the corrugation teeth formed on the primary corrugation roller and the secondary corrugation roller of one of the corrugation roller sets are of a size different from the corrugation teeth formed on the primary corrugation roller and the secondary corrugation roller of the other corrugation roller set.

4. The corrugator according to claim 3 wherein the two corrugation roller sets are arranged in a symmetric manner with respect to the roller support seats.

5. The corrugator according to claim 4 wherein the primary corrugation roller has an axle and the secondary corrugation roller has an axle.

6. The corrugator according to claim 1, wherein one of the primary wall panels is provided with a rotation positioning hydraulic cylinder, which carries and drives an extendible/retractable positioning pin, the detachable secondary wall panels of one of the corrugation roller sets being provided with a rotation positioning seat, which forms a positioning slot for selectively receiving the positioning pin of the rotation positioning hydraulic cylinder to fit therein or separate therefrom, whereby when the positioning pin is fit in the positioning slot, the two corrugation roller sets are angularly positioned at the same altitude to allow one of the corrugation roller sets to perform operation.

7. The corrugator according to claim 6, wherein the hold-down roller has an axle that has two ends each rotatably coupled to a lever, which is pivoted at a middle portion thereof to one of the primary wall panels corresponding thereto, the lever having an end, which is opposite to the hold-down roller, rotatably coupled to a force-application hydraulic cylinder, which is mounted to the corresponding primary wall panel and comprises an extendible/retractable driving rod that is coupled to the lever.

8. The corrugator according to claim 7, further comprising an adhesive application roller, which is arranged between the two primary wall panels to carry adhesive deposited thereon, the adhesive application roller being located close to one of the primary corrugation roller and the secondary corrugation roller of one of the corrugation roller sets.

* * * * *